US012768116B2

(12) United States Patent
Tozer

(10) Patent No.: US 12,768,116 B2
(45) Date of Patent: Oct. 20, 2026

(54) SWEEPER APPARATUS

(71) Applicant: Glide-Tec Pty Ltd, Strathewen (AU)

(72) Inventor: Cameron Ronald Tozer, Strathewen (AU)

(73) Assignee: GLIDE-TEC PTY LTD, Strathewen (AU)

( * ) Notice: Subject to any disclaimer, the term of this patent is extended or adjusted under 35 U.S.C. 154(b) by 403 days.

(21) Appl. No.: 18/336,819

(22) Filed: Jun. 16, 2023

(65) Prior Publication Data

US 2023/0407585 A1 Dec. 21, 2023

(30) Foreign Application Priority Data

Jun. 17, 2022 (AU) ..... 2022901650

(51) Int. Cl.
*E01H 1/04* (2006.01)
*E01H 1/10* (2006.01)
*E01H 1/12* (2006.01)

(52) U.S. Cl.
CPC ..... *E01H 1/106* (2013.01)

(58) Field of Classification Search
CPC .. E01H 1/106; E01H 1/04; E01H 1/12; E01H 1/047; E01H 2001/122
See application file for complete search history.

(56) References Cited

U.S. PATENT DOCUMENTS 5,284,211 A * 2/1994 Tozer ..... E01H 1/12 172/197
5,918,684 A * 7/1999 Tozer ..... E01C 23/082 172/612
6,079,503 A * 6/2000 Tozer ..... E01H 1/12 172/612
6,257,345 B1 * 7/2001 Tozer ..... E01H 1/12 172/612
6,454,018 B2 * 9/2002 Tozer ..... E01C 23/082 172/29
8,250,696 B2 * 8/2012 Tozer ..... A46B 15/00 172/612

(Continued)

FOREIGN PATENT DOCUMENTS

DE 202016103520 U1 * 10/2017 ..... E01C 23/082
EP 3884109 B1 * 12/2023 ..... E01H 1/04

(Continued)

*Primary Examiner* — Marc Carlson
(74) *Attorney, Agent, or Firm* — McCoy Russell LLP

(57) ABSTRACT

An apparatus for sweeping a ground surface, comprises: a panel member configured to be moved across a ground surface to sweep the ground surface, the panel member having an underside that, in use, faces the ground surface to be swept, an upper side that provides a collection surface for collecting debris swept from the ground surface, and one or more openings that extend between the underside and the upper side for conveying debris from the ground surface to the collection surface on the upper side of the panel member; and a debris retaining assembly configured to be mounted on the panel member for trapping the debris conveyed to the collection surface on the upper side of the panel member. The debris retaining assembly comprises a frame and a flexible cover supported spaced above the collection surface by the frame when the assembly is mounted on the panel member.

19 Claims, 6 Drawing Sheets

(56) References Cited

U.S. PATENT DOCUMENTS

| | | | | |
|---|---|---|---|---|
| 8,839,878 | B2 * | 9/2014 | Tozer | E01H 1/02 172/199 |
| 10,808,369 | B2 * | 10/2020 | Tozer | E01H 1/047 |
| 2012/0047666 | A1 * | 3/2012 | Tozer | E01H 1/02 15/3 |
| 2018/0282959 | A1 * | 10/2018 | Tozer | E01H 1/04 |
| 2022/0074150 | A1 * | 3/2022 | Tozer | E01H 15/00 |

FOREIGN PATENT DOCUMENTS

| | | | | |
|---|---|---|---|---|
| WO | WO-2009026624 | A1 * | 3/2009 | E01H 1/106 |
| WO | WO-2017075651 | A1 * | 5/2017 | E01H 1/047 |
| WO | WO-2020102848 | A1 * | 5/2020 | E01H 1/04 |

* cited by examiner

SWEEPER APPARATUS

CROSS REFERENCE TO RELATED APPLICATION

The present application claims priority to Australian Patent Application No. 2022901650 filed on Jun. 17, 2022. The entire contents of the above-listed application are hereby incorporated by reference for all purposes.

TECHNICAL FIELD

The present disclosure relates to a sweeper apparatus, and more particularly to an apparatus for sweeping ground surfaces in an outdoor environment. The apparatus of this disclosure may be used for sweeping ground surfaces in a range of locations and contexts, including playing fields, golf courses, automotive racetracks, as well as airfields and airport tarmacs to prevent debris interfering with aircraft.

It will be convenient to hereinafter describe the present disclosure in relation to a sweeper apparatus for the collection of debris from an outdoor playing field, such as a football pitch, hockey pitch or tennis court. In this context, the debris to be collected may include leaves, twigs, seed pods, and/or other litter from the surrounding trees and shrubs, but may also include foreign objects, such as metal objects, that may have found their way onto the field. As noted above, however, the apparatus of this disclosure is not limited to outdoor playing fields and may be used for sweeping ground surfaces in a variety of locations and contexts. Indeed, the sweeper apparatus may also be suitable for use in some indoor applications. For the purposes of this disclosure, therefore, the term "ground surface" as it is used herein will be understood to include any ground covering of the area to be swept, including, but not limited to, grass, artificial grass, synthetic rubber, asphalt, concrete, and paving.

BACKGROUND ART

Any reference to or discussion of background art, including to any documents, herein is intended to facilitate an understanding of the present disclosure only and is not to be considered as an admission that such background art forms part of the state of the art or is widely known or forms a part of the common general knowledge in the relevant field in Australia or in any other country at the date of this application.

Apparatuses of this general type for collecting debris from the ground surfaces of outdoor playing fields and airfields are known. An example of such an apparatus is described in the International patent application published as WO 2017/075651 A1. The present disclosure is concerned with providing a new or improved sweeper apparatus or with providing a useful alternative to the known apparatuses.

SUMMARY

According to one broad aspect, the present disclosure provides an apparatus for sweeping a ground surface, comprising: a panel member configured to be moved across a ground surface to sweep the ground surface, the panel member having an underside which, in use, faces the ground surface to be swept, an upper side which provides at least one collection surface for collecting debris swept from the ground surface, and one or more openings that extend between the underside and the upper side for conveying debris from the ground surface to the collection surface/s on the upper side of the panel member; and a debris retaining assembly configured to be mounted on the panel member for trapping the debris conveyed to the collection surface/s on the upper side of the panel member, wherein the debris retaining assembly comprises a frame with at least one frame member and a cover, desirably a flexible cover, supported on the frame spaced above the collection surface/s when the debris retaining assembly is mounted on the panel member.

In this way, the at least one frame member cooperates with the cover to form or define a collection space between the cover and the collection surface/s on the upper side of the panel member. This arrangement provides enhanced debris collection performance and can provide the user with a clearer view of the debris that accumulates in the collection space. It may also facilitate better access for a user when emptying the debris from the collection space.

In an embodiment, the at least one frame member comprises a rib or a strut or a batten for supporting the cover spaced above the at least one collection surface. In this context, the frame member (e.g., the rib or strut or batten) may preferably span or extend across a substantial width of the panel member. It will be appreciated that each frame member, preferably in the form of a relatively long and thin rod or strip, should preferably be relatively stiff and yet sufficiently flexible for bending to adopt a desired curved profile for shaping the cover of the assembly. To this end, each frame member may be comprised of a durable and light-weight material, such as polymer plastic. Some examples of suitable plastics include polyamide (PA, Nylon), polyethylene (PE, HDPE), polyvinylchloride (PVC), polycarbonate (PC), and polyurethane (PU). It will also be appreciated that other materials, including composites, such as fibre-reinforced polymer, (e.g., fibreglass), and metals, such as steel or aluminium, would also be suitable for the frame member(s). In this regard, each elongate frame member will preferably be resiliently flexible.

In an embodiment, the at least one frame member is configured to be secured, preferably in a releasable manner, to the panel member to form or define a collection space between the cover and the collection surface/s on the upper side of the panel member.

In an embodiment, the at least one frame member comprises a plurality of frame members. These are preferably arranged to extend substantially parallel to one another, and preferably transversely or laterally across a width of the panel member, which may facilitate rolling up of the apparatus for storage. Thus, the at least one frame member will preferably extend substantially parallel to a leading edge of the panel member, especially if the panel member is generally rectangular, and/or perpendicular to the direction of travel. It will be appreciated, however, that other orientations of the one or more frame members are also possible; e.g., extending in the direction of travel.

In an embodiment, the at least one frame member comprises a single frame member and/or forms or defines a single span transversely or laterally across a width of the panel member. In this regard, the span preferably extends substantially parallel to a leading edge of the panel member, especially if the panel member is generally rectangular. This arrangement provides easier collapsibility of the debris retaining assembly for storage; i.e., when there is only a single frame member or only a single span supporting the cover that is to be collapsed; for example, as the sweeper apparatus is rolled-up and/or folded away for storage. It should be appreciated that, though it is possible to disassemble the sweeper apparatus to separate the debris retaining assembly from the panel member, one of the advantages of this disclosure is that the sweeper apparatus can be conveniently compacted and stored without the need for such disassembly.

In the case of the at least one frame member defining a single span transversely or laterally across the width of the panel member, it will be appreciated that the at least one frame member may still comprise a plurality of frame members (e.g., ribs or struts or battens). In such a case, the plurality of frame members combine with one another (e.g., in end-to-end relationship) to form the single span. By dividing the span into a plurality of separate frame members in this way, the collapsibility may be further enhanced.

In an embodiment, the cover comprises a flexible sheet of material and the at least one frame member shapes the cover over the collection surface/s. In this context, the cover may be stretched or tensioned over the at least one frame member. For example, the cover may comprise a textile material and/or a mesh material which is air-permeable. Alternatively, the cover may comprise a sheet of plastic material, which may optionally be perforated to allow air transmission. The air permeability enables the air or wind to travel through the cover as the apparatus is moved across the ground surface in use. Further, the cover may comprise an elastic material or a 'stretch' material to facilitate tensioning or shaping of the cover over the at least one frame member. The at least one frame member may be connected to and/or incorporated in the cover to form an integrated debris retaining assembly configured to be mounted on the panel member. In this regard, the cover may include one or more sleeves, channels, cuffs, or pockets for receiving a respective frame member (e.g., rib or strut or batten) therein. Alternatively, the frame member(s) and/or the cover may include one or more fasteners or clips for interconnecting the frame member(s) and the cover. For example, hook and loop fasteners, such as Velcro™, may be used to interconnect the cover with the frame member(s). The elastic nature of the material of the cover, including the one or more sleeves, channels, or pockets for receiving the respective frame member/s (e.g., rib/s, strut/s, or batten/s) therein may enhance the collapsible nature of the debris retaining assembly of the sweeper apparatus (e.g., in storage) by providing a more readily deformable configuration.

In an embodiment, the cover is configured to be releasably fixed to or mounted on the panel member, preferably via one or more straps and releasable fasteners, such as hook and loop fasteners, like Velcro™. This is useful for the quick and easy assembly and disassembly of the apparatus before and after use. In an alternative embodiment, the cover may be integrally connected to the panel member of the apparatus, and the at least one frame member may optionally be removable or separable from the cover to allow the cover to lie flat against panel member in a more compact configuration when not in use; e.g., for storage. In this context, the debris retaining assembly comprising the frame and the cover is preferably collapsible when it is not fixed to or mounted on the panel member for compact storage. Alternatively, or in addition, the debris retaining assembly comprising the frame and the cover is desirably collapsible when it is fixed to or mounted on the panel member for compact storage. For example, the sweeper apparatus of the disclosure may be adapted to be rolled up for storage when not in use. By configuring the debris retaining assembly sufficiently flexible and resilient, the sweeper apparatus may be rolled up with the debris retaining assembly mounted on the panel member. To this end, the cover may comprise an elastically stretchable textile and each frame member (e.g., rib, strut or batten) may be highly flexible. Where the frame members are connected to and/or incorporated in the cover, the cover may thus simply stretch as the frame members are deformed during rolling up of the panel member.

In an embodiment, the cover, when mounted on the panel member, defines an opening into a collection space between the cover and the upper side of the panel member. The opening faces a forward direction or a direction of travel in which the apparatus is configured to be moved across the ground surface. The opening may optionally extend across a substantial width of the panel member. The front opening or forward-facing opening provides a clear and unobstructed view of the debris in the collection space and provides easy access for a user to remove collected items. This arrangement also operates to collect debris that may be flicked-up by a leading edge of the apparatus as it is moved over the ground surface.

In an embodiment, the cover may include a (re)movable closure, such as a flap, for the front opening or forward-facing opening. In this way, the front opening or forward-facing opening need not be permanently open but may also be closed or obscured when desired or practical. The closure preferably comprises the same material as the cover. The closure, which may be in the form of a fabric panel, can be movable or removable from the opening such that the sweeper apparatus can be used with the opening in either a closed state or an open state. One or more fasteners, such as a zipper or other suitable fastening means, e.g., studs or Velcro™ straps, can be provided for removably securing the closure to the cover around a periphery of the opening.

According to another aspect, the disclosure provides an apparatus for sweeping a ground surface, comprising: a panel member configured to be moved across the ground surface to sweep the ground surface, the panel member having an underside that, in use, faces the ground surface to be swept, and an upper side that provides a collection surface or a plurality of collection surfaces for collecting debris swept from the ground surface; and a cover configured to be mounted on the panel member for trapping the debris conveyed to the one or more collection surfaces on the upper side of the panel member. The cover, when mounted on the panel member, forms a canopy that is supported spaced above the panel member to define a collection space between the cover and the upper side of the panel member. The panel member typically includes a plurality of openings that extend between the underside and the upper side for conveying debris from the ground surface to the collection surface/s.

In an embodiment, the cover is self-supporting. In this way, the cover may have sufficient stiffness or rigidity to be supported on the panel member without an independent frame. That is, the cover may be formed from a material that does not require a separate frame. Thus, while the cover is preferably flexible and/or foldable so as to be collapsible for compact storage, in an in-use configuration, the cover still forms a canopy that is self-supported spaced above the panel member to define a collection space for the debris. Alternatively, the cover may be supported on a frame structure, as described above. In an embodiment, the cover, when mounted on the panel member, presents an opening into the collection space between the cover and the upper side of the panel member, wherein the opening faces a direction in which the apparatus is configured to be moved across the ground surface to sweep the ground surface.

In an embodiment, the panel member is preferably flexible and may comprise a mat-like structure. Length and width dimensions of the panel member may be selected to suit a particular use, but these dimensions may, for example, be in the range of about 1.0 to 3.0 metre(s) for length and about 1.0 to 3.0 metre(s) for width. The apparatus can be moved across the ground surface manually to perform the sweeping operation but both the drag resistance exerted by the ground surface and the size of the area to be swept will typically render manual operation impractical. Thus, more typically, the apparatus will be moved across the ground surface mechanically, e.g., by towing the apparatus behind a vehicle driven by the user. The towing speed may vary depending on the surface being swept and the size of the area to be covered. Towing speeds in the range of about 5 to 45 kilometres per hour (km/h) are typical for playing fields, airports, automotive racetracks, and for other sealed or paved surfaces. For grass surfaces, towing speeds in a lower end of that range (e.g., about 5 to 30 km/h) are more typical.

In an embodiment, each opening between the underside and the upper side of the panel member for conveying debris from the ground surface to the collection surface extends transversely or laterally of the panel member. The one or more collection surfaces is/are arranged or provided on the upper side of the panel member adjacent an opening or a group of openings.

In an embodiment, the panel member includes a plurality of collection surfaces at locations which are spaced apart from one another longitudinally along the length of the apparatus, i.e., in the direction of travel or movement, with each collection surface being associated with a respective opening or group of openings in the panel member.

In an embodiment, each of the one or more openings in the panel member includes or is formed in a guide structure for guiding transfer or conveyance of debris from the ground surface to the respective collection surface of the apparatus. To this end, the guide structure includes an inclined surface which extends upwards and rearwards, in use, from a position at or close to the ground surface to a collection surface on the upper side of the panel member. The inclined surface typically extends to a rear edge of the respective or associated opening. When the apparatus is moved over the ground surface, e.g., hand-drawn or by vehicle towing, the debris then passes from the underside of the apparatus along the inclined surfaces and through the openings to the respective collection surfaces.

In an embodiment, the panel member includes ground-engaging elements for agitating loose debris such as leaves, stones, twigs and the like on the ground surface by contact therewith. The ground-engaging elements are preferably provided forward of the one or more openings in the direction of travel. In this regard, each of the one or more openings may have associated ground-engaging elements provided forward thereof. The ground-engaging elements may, for example, comprise pads of bristles or flexible rubber strands, carpet or other textiles. The ground-engaging elements should preferably agitate the loose debris without causing damage to the ground surface being swept.

According to a further aspect, the present disclosure provides a sweeper for a ground surface, comprising: a mat-like panel configured to be moved across the ground surface to sweep the ground surface, the panel having an underside that, in use, faces the ground surface to be swept, an upper side that provides at least one collection surface for collecting debris swept from the ground surface, and one or more openings that extend between the underside and the upper side for conveying debris from the ground surface to the collection surface/s on the upper side of the panel member; and a flexible cover configured to be mounted on the upper side of the panel for trapping the debris conveyed to the collection surface, wherein the cover is supported spaced above the collection surface by a frame when the cover is mounted on the panel member and wherein the cover is open in a forward-facing direction.

According to another aspect, the present disclosure provides a debris retaining assembly for an apparatus for sweeping a ground surface with a panel member, an underside of the panel member in use facing the ground surface to be swept and an upper side of the panel member providing one or more collection surfaces for collecting debris swept from the ground surface. The debris retaining assembly is configured to be mounted on the panel member for trapping the debris conveyed to the collection surface/s on the upper side of the panel member, wherein the debris retaining assembly comprises a frame with at least one frame member and a cover supported on the frame so as to be spaced above the collection surface when the assembly is mounted on the panel member. In this regard, it will be noted that the debris retaining assembly of the disclosure may be designed to be retro-fitted to an existing sweeper apparatus.

According to yet a further aspect, the present disclosure provides a cover for an apparatus for sweeping a ground surface with a panel member, an underside of the panel member in use facing the ground surface to be swept, and an upper side of the panel member providing a collection surface for collecting debris swept from the ground surface. The cover is configured to be mounted on the panel member for trapping debris conveyed to the collection surface on the upper side of the panel member, wherein the cover, when mounted on the panel member, forms a canopy that is spaced above the panel member to define a collection space between the cover and the upper side of the panel member. As above, the cover may be configured to be retro-fitted to an existing sweeper apparatus.

Some advantages provided by embodiments of the sweeper apparatus of the present disclosure may include the following: (i) fewer components, like toggles, battens, tabs, heat shrink; (ii) quicker and easier set up and disassembly; (iii) easier emptying of the collected debris via access through the opening without removing the cover; (iv) a better view of debris in the collection space; and (v) collection of debris flicked-up by the leading edge of the sweeper.

BRIEF DESCRIPTION OF THE DRAWINGS

For a more complete understanding of the present disclosure and advantages thereof, exemplary embodiments are explained in more detail in the following description with reference to the accompanying drawing figures, in which like reference signs identify or designate like parts and in which.

Figure 1:
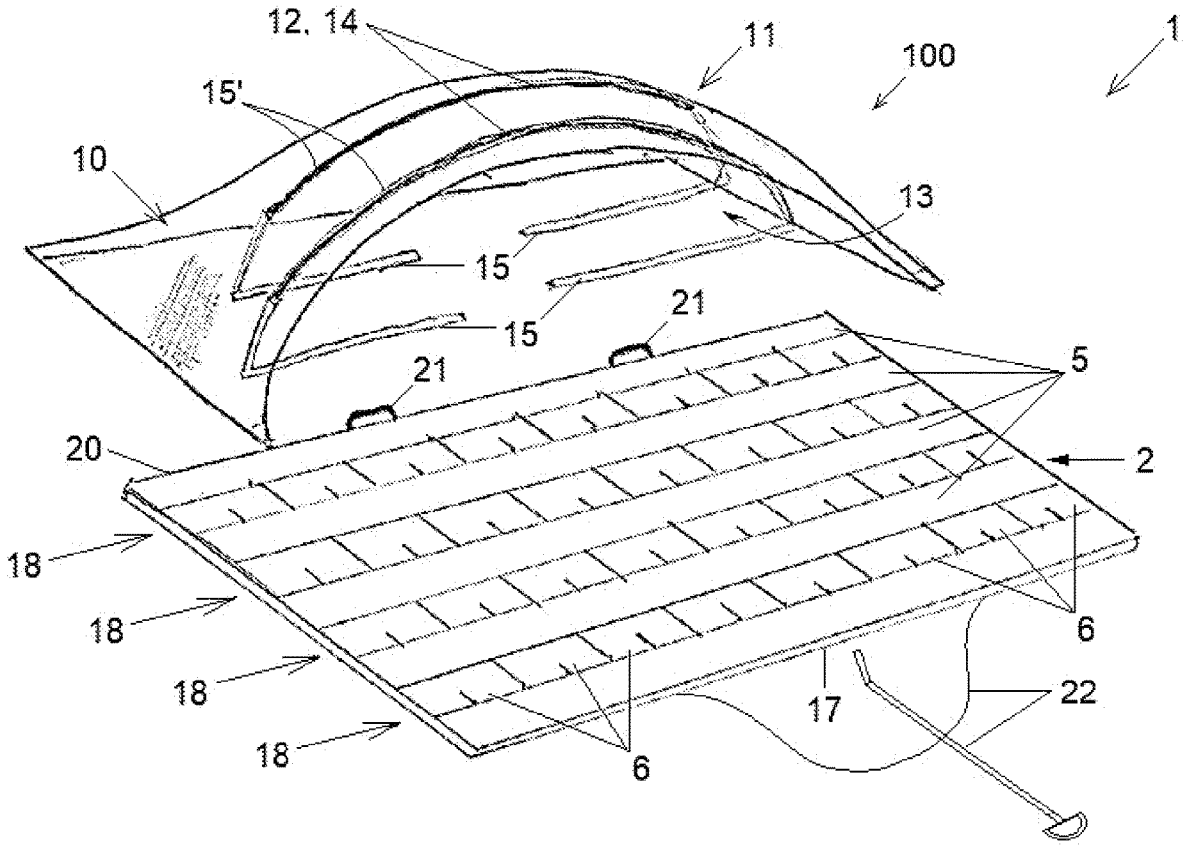
FIG. 1 is a perspective view of a sweeper apparatus according to an embodiment of the present disclosure, with a debris retaining assembly shown separate.

The accompanying drawings are included to provide a further understanding of the present disclosure and are incorporated in and constitute a part of this specification. The drawings illustrate particular embodiments and together with the description serve to explain the principles of the disclosure. Other embodiments and many of the attendant advantages will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will also be understood that certain actions and/or steps in an embodiment of a method may be described or depicted in a particular order of occurrences while those skilled in the art will understand that such specificity with respect to sequence is not actually required.

DETAILED DESCRIPTION OF THE EMBODIMENTS

With reference to drawings FIGS. 1 to 4, a sweeper apparatus 1 according to an embodiment of the present disclosure is illustrated in a range of views. The sweeper apparatus 1 comprises a panel member 2 having a flexible mat-like structure configured to be moved e.g., by towing, across a ground surface G to sweep the ground surface. The panel member 2 has an underside 3 which, in use, faces the ground surface G to be swept, and an upper side 4 which includes a series of collection surfaces 5 for collecting debris swept from the ground surface G. The panel member 2 further includes a plurality of openings 6 that extend between the underside 3 and the upper side 4 for conveying debris (not shown) from the ground surface G to the collection surfaces 5 on the upper side 4 of the panel member 2. To this end, each of the openings 6 in the panel member 2 includes, or is formed, in a guide structure 7 for guiding the transfer or conveyance of the debris from the ground surface G to the collection surfaces 5 of the apparatus 1. The guide structure 7 at each opening 6 includes an inclined surface 8 which extends, in use, upwards and rearwards from a position adjacent or close to the ground surface G to the associated collection surface 5 on the upper side 4 of the panel member 2. In this connection, the inclined surface 8 extends to a rear edge 9 of the respective or associated opening 6. When the apparatus 1 is moved over the ground surface G, the debris passes from the underside 3 of the apparatus 1 along the inclined surfaces 8 of the guide structures 7 and through the openings 6 to the collection surfaces 5. The collection surfaces 5 In this embodiment comprise sections of mesh material with an array of apertures (not shown) that permit small particles, such as crumb rubber, rubber infill, sand or other infill materials, swept up off ground surface G to pass back to the ground surface G through the mesh.

The sweeper apparatus 1 further comprises an assembly 100 that is configured to be mounted on the panel member 2 for trapping the debris that is conveyed to the collection surfaces 5 on the upper side 4 of the panel member 2. The assembly 100 for catching or retaining the debris includes a cover 10 and a frame 11. When mounted on the panel member 2, the cover 10 is supported spaced above the collection surfaces 5 by the frame 11 comprising at least one frame member 12. In this way, the frame 11 cooperates with the cover 10 to form or define a collection space 13 between the cover 10 and the collection surfaces 5 on the upper side 4 of panel member 2. This arrangement provides the user with a clearer view of the debris that accumulates in the collection space 13 and can also facilitate better access when emptying the debris from the collection space. In this embodiment, the at least one frame member 12 comprises two substantially parallel ribs or struts or battens 14 which extend laterally across the panel member 2 for supporting the cover 10 spaced above the collection surfaces 5. In this context, the ribs or struts or battens 14 span or extend across substantial the full width of the panel member 2. Further, the ribs or struts or battens 14 are configured to be secured in a releasable manner to the panel member 2 to form or define the collection space 13.

The cover 10 comprises an expanse of a flexible textile mesh or fabric material and the frame 11 shapes the cover 10 over the collection surfaces 5. In this context, the cover 10 may be stretched or tensioned over the frame members 12. To this end, the mesh cover 10 may include an elastic material or a 'stretch' material to facilitate the tensioning or shaping of the cover 10 over the frame 11. In this embodiment, the frame members 12 are fibreglass battens 14 having a rectangular cross-section (i.e., similar to sail battens), preferably with dimensions of 15 mm×3 mm, although round cross-sectioned fibreglass rods (e.g., up to 8 mm diameter) would also be suitable. The frame members 12 (i.e., ribs or battens 14) are configured to be releasably fixed or mounted on the panel member 2, preferably via one or more straps 15 with releasable fasteners, such as hook and loop fasteners, like Velcro™. This is useful for the quick and easy assembly and disassembly of the apparatus before and after use. Alternatively, or in addition, the cover 10 itself includes integral sleeves 15' for receiving the elongate and flexible ribs or struts or battens 14 which then tension or shape the cover 10. This way, the frame members 12 (i.e., ribs or struts or battens 14) are received or integrated in the sleeves or pockets 15' in the flexible cover 10 to form the debris retaining assembly 100.

Figure 3:
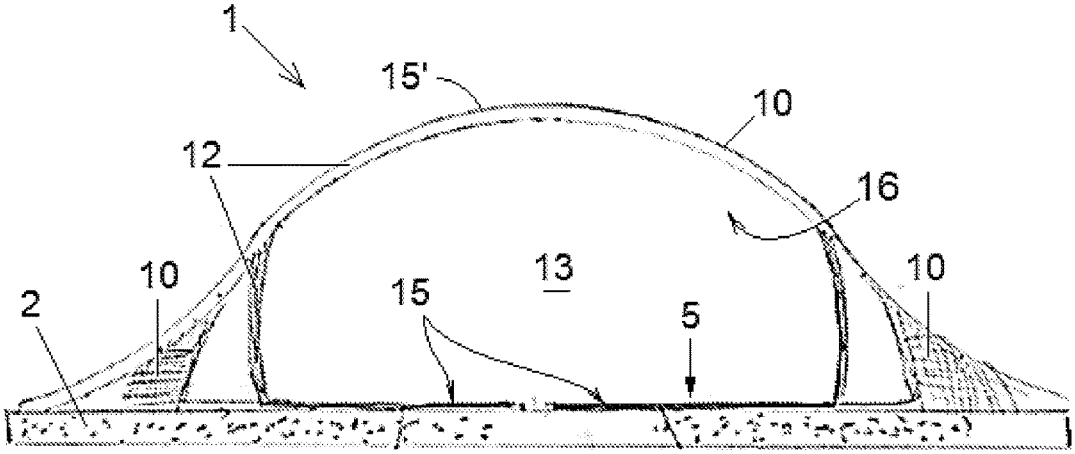
FIG. 3 is a front view of the sweeper apparatus in FIGS. 1 and 2.
Figure 4:
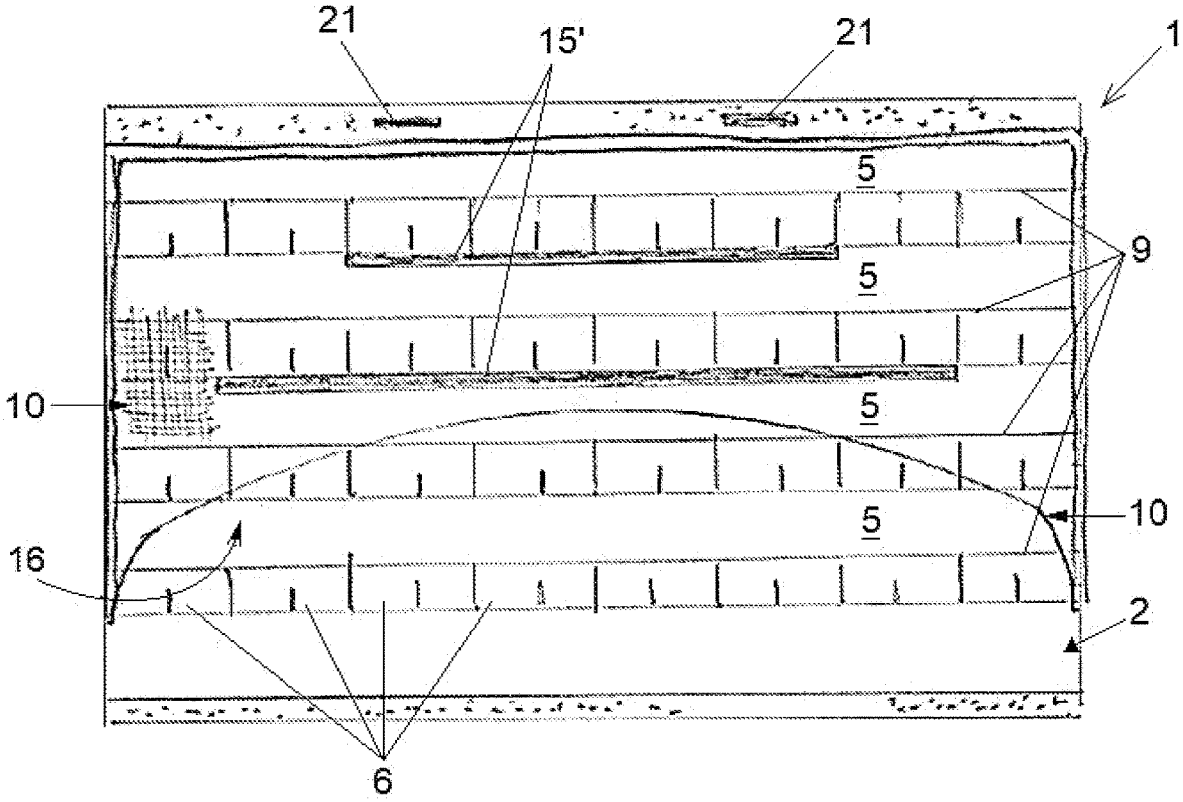
FIG. 4 is a top view of the sweeper apparatus of FIGS. 1 to 3.

As can be clearly seen in FIGS. 1, 3 and 4, when mounted on the panel member, the cover 10 has or defines forward-facing opening 16 into the collection space 13 formed between the cover 10 and the upper side 4 of the panel member. That is, the opening 16 faces a forward direction or a direction of travel T in which the apparatus 1 is configured to be moved across the ground surface G. Furthermore, the opening 16 extends across a substantial width of the panel member 2, thereby providing a user a clear and unobstructed view of the debris in the collection space 13 as well as easy access to remove collected items. This wide forward-facing opening 16 also operates to collect debris that is flicked-up by a leading edge 17 of the apparatus 1 as it is moved over the ground surface G.

The length and width dimensions of the panel member 2 may be selected to suit the particular use, but these dimensions in this embodiment are about 1.5 metres for length and about 2.5 metres for width. A plurality of openings 6 between the underside 3 and the upper side 4 of the panel member 2 for conveying the debris from the ground surface G to the collection surfaces 5 are arranged side-by-side and extend transversely or laterally of the panel member 2 in separate rows 18. Similarly, the plurality of collection surfaces 5 are arranged at locations which are spaced apart from one another along the length of the apparatus, i.e., in the direction of in-use travel or movement of the apparatus 1, with each collection surface 5 being associated with a respective row 18 of openings 6 in the panel member 2.

Figure 2:
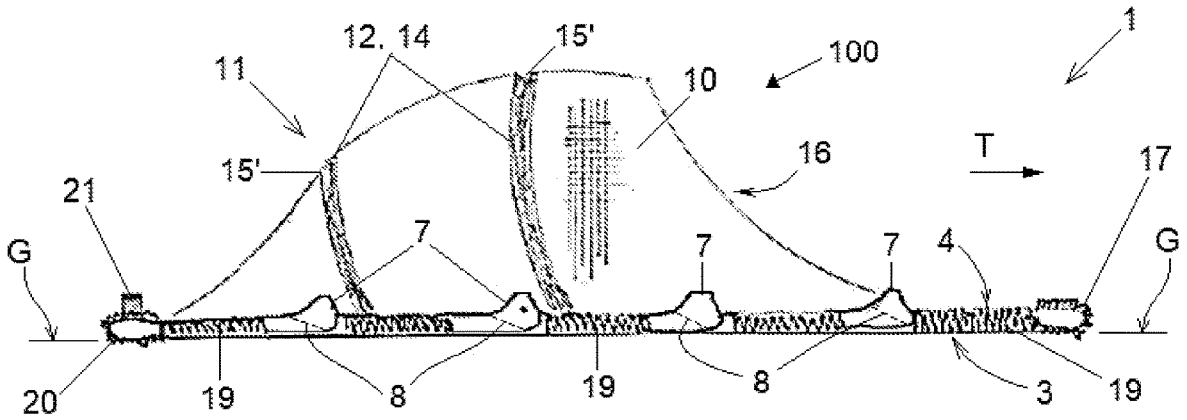
FIG. 2 is a side view of the sweeper apparatus of FIG. 1.

The underside 3 of the mat-like panel member 2 includes a ground-engaging pad or strip 19 extending across its width for agitating loose debris such as leaves, stones, twigs and the like (or foreign objects, e.g., metal objects, such as nuts, bolts, screws, hair pins) on the ground surface G as the apparatus 1 is moved over the ground. The ground-engaging pad or strip 19 is provided along the leading edge 17 of the panel member 2 forward of the openings 6 in the direction of travel T. The ground-engaging pad 19 includes elements, such as bristles or flexible rubber strands, to agitate the loose debris without causing damage to the ground surface G being swept. Also, as can be seen in FIGS. 1, 2 and 4, a trailing edge 20 of the mat-like panel member 2 includes handles 21 for lifting and carrying the apparatus 1 before and after use. The handles 21 are also used for holding and shaking the apparatus 1 to empty the collected debris out of the collection space 13, with the debris then able to fall out of the forward-facing opening 16. The handles 21 may also be used for hanging up the mat-like panel member 2 in storage, i.e., when not in use. A towing member 22 is preferably provided attached to the leading edge 17 of the panel member 2 for hand-drawn or vehicle-towed movement of the sweeper apparatus 1 over the ground surface G. In this regard, the towing member 22 may, for example, be provided in the form of a flexible cord (e.g., for hand-drawn use) or a rigid linkage (e.g., for connection to a vehicle).

Figure 5:
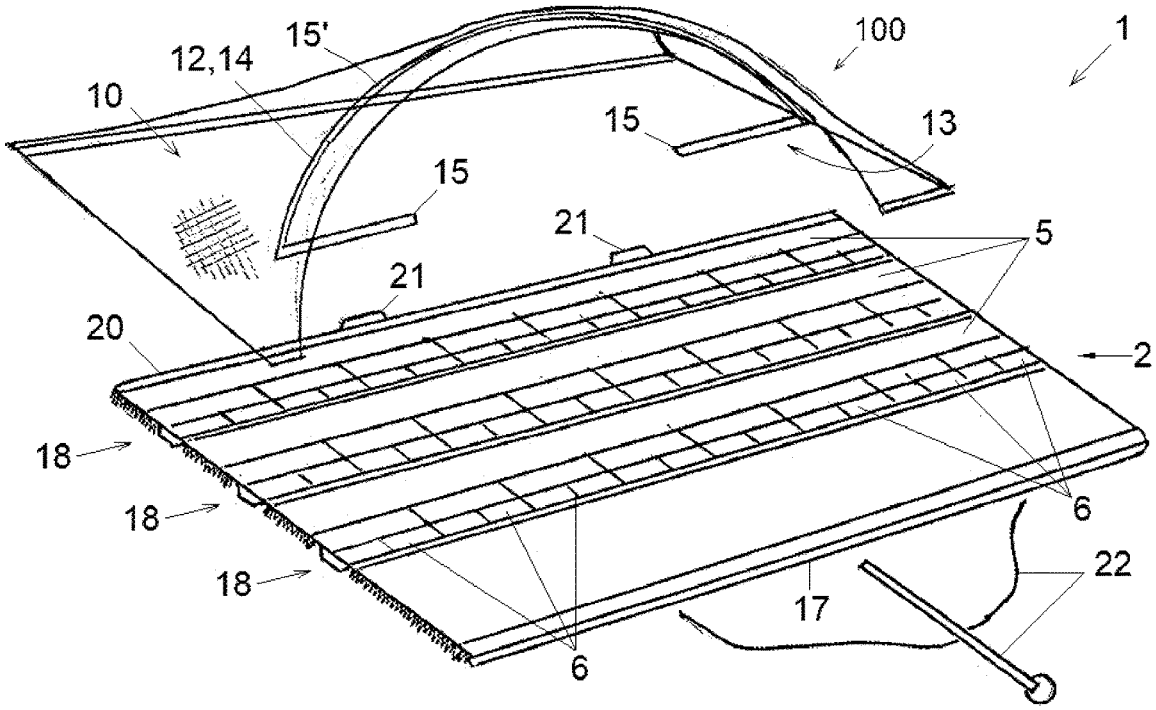
FIG. 5 is a perspective view of a sweeper apparatus according to another embodiment of the present disclosure, with a debris retaining assembly shown separate.
Figure 6:
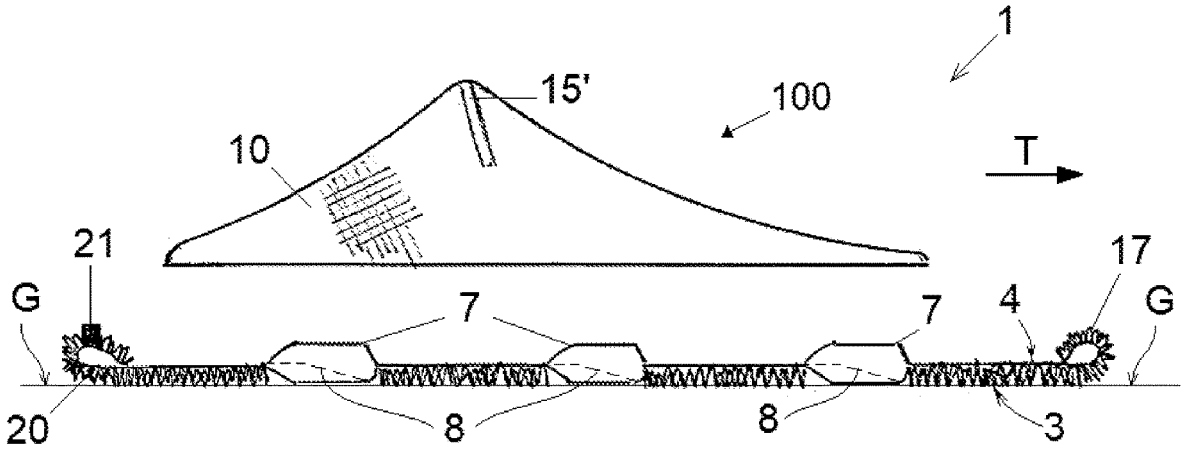
FIG. 6 is a side view of the sweeper apparatus of FIG. 5.
Figure 7:
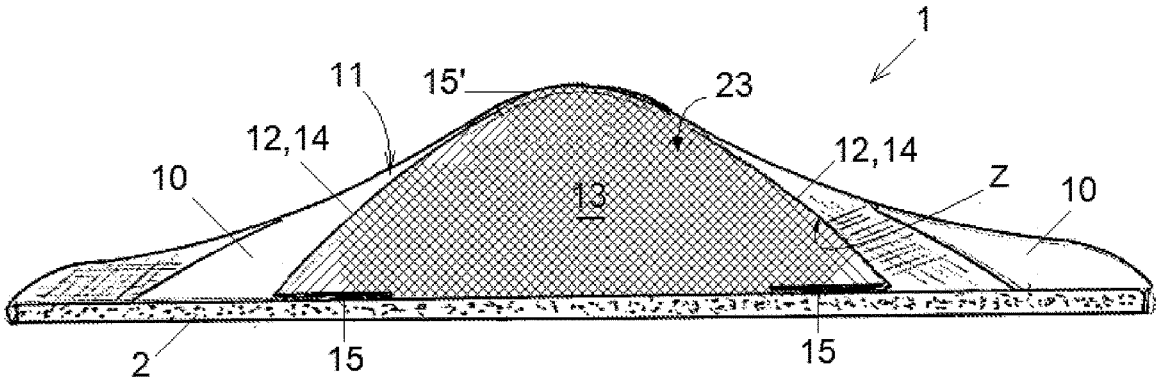
FIG. 7 is a front view of the sweeper apparatus in FIGS. 5 and 6.

Referring now to FIGS. 5 to 7 of the drawings, a sweeper apparatus 1 according to another embodiment of the present disclosure is illustrated in different views. As before, the sweeper apparatus 1 comprises a panel member 2 having a flexible mat-like structure configured to be moved e.g., by towing, across a ground surface G to sweep the ground surface. The panel member 2 has an underside 3 which, in use, faces the ground surface G to be swept, and an upper side 4 having a series of collection surfaces 5 for collecting debris swept from the ground surface G. The panel member 2 has multiple openings 6 that extend between the underside 3 and the upper side 4 for conveying debris (not shown) from the ground surface G to the collection surfaces 5 on the upper side 4 of the panel member 2. To this end, each opening 6 in the panel member 2 again includes, or is formed, in a guide structure 7 for guiding the transfer or conveyance of the debris from the ground surface G to the collection surfaces 5 of the apparatus 1. The guide structure 7 at each opening 6 includes an inclined surface 8 that extends, in use, upwards and rearwards from a position at or adjacent to the ground surface G to an associated collection surface 5 on the upper side 4 of the panel member 2. This way, when the sweeper apparatus 1 is moved over the ground surface G, the debris passes from the underside 3 of the apparatus 1 and up the inclined surfaces 8 of the guide structures 7 through the openings 6 to the collection surfaces 5.

As like reference signs designate like parts in the sweeper apparatus 1 shown in drawing FIGS. 5 to 7, it will not be necessary to repeat the description of those features already discussed in detail above. This description therefore concentrates on the features of this embodiment which differ from the sweeper apparatus 1 shown in FIGS. 1 to 4. In this regard, it will be apparent from FIGS. 5 and 6 that the frame 11 of the debris retaining assembly 100 of the sweeper apparatus 1 comprises a single fame member 12 in the form of a curved rib or batten 14. That frame member 12 forms or defines a single span that extends transversely or laterally across a width of panel member 2 substantially parallel to the leading edge 17 and substantially perpendicular to the direction of travel T. Again, the curved rib or batten 14 is received or held in a sleeve or pocket 15' of the cover 10 and shapes that cover 10 as shown in the drawings. The rib or batter 14 is preferably fibreglass, once again with a rectangular cross-section of about 15 mm×3 mm, although round cross-sectioned fibreglass rods (e.g., up to 8 mm diameter) would also be suitable. The cover 10 of this embodiment includes a movable closure 23, such as a flap or a fabric panel of the same material, arranged across the opening 16 into the collection space 13. In this way, the front or forward-facing opening 16 may optionally be closed or obscured as desired. A zipper Z or other suitable fastening means, such as studs or Velcro straps, can be provided for attaching or securing the movable closure 23 to the cover 10 around a periphery of the opening 16. As before, the assembly 100 is configured to be releasably fixed to the panel member 2 by straps 15 provided at the ends of the frame member 12. The fact that the frame 11 of the assembly 100 has only a single lateral span in this embodiment, here with just a single batten or rib 14, provides easier collapsibility for storage when the sweeper apparatus 1 is rolled-up and/or folded for storage.

Figure 8:
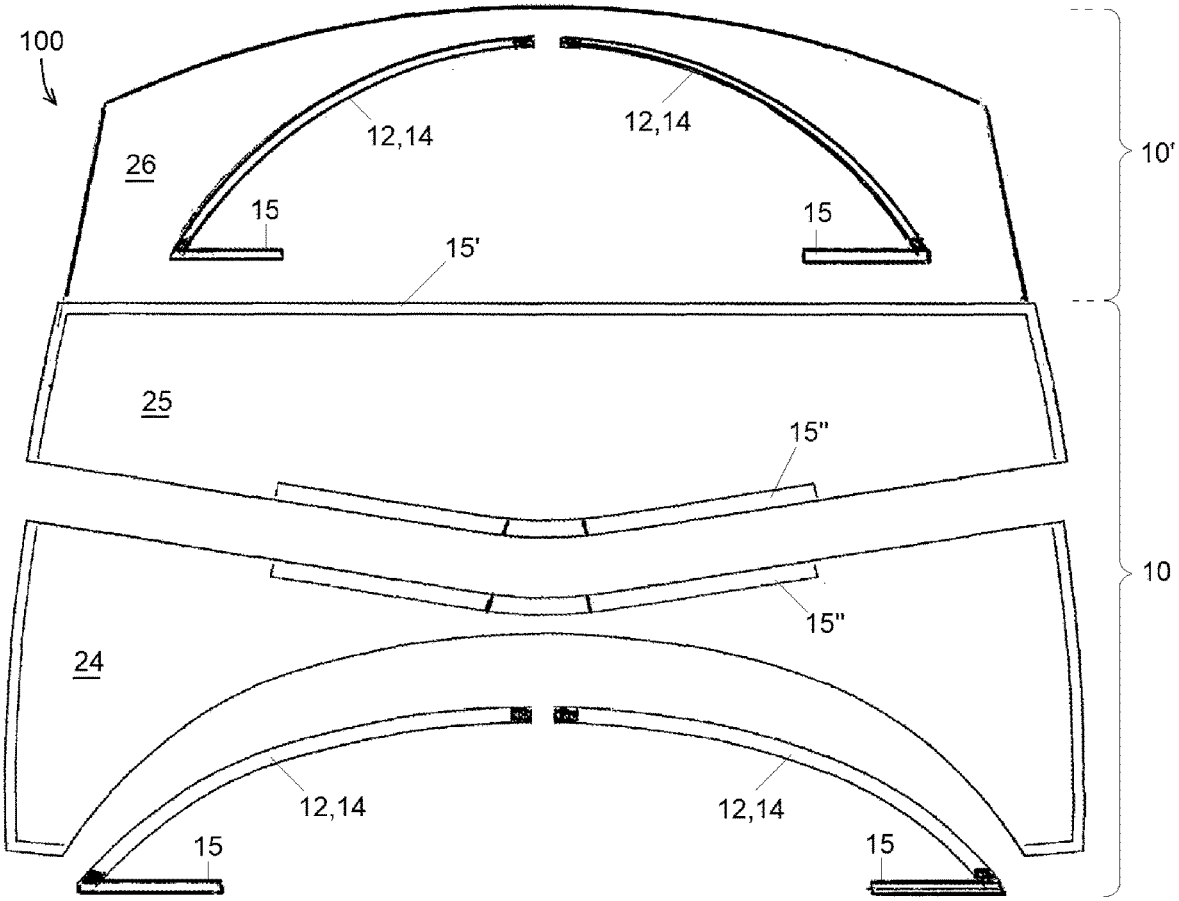
FIG. 8 is a top view of a debris retaining assembly for a sweeper apparatus according to a further embodiment of the disclosure.
Figure 9:
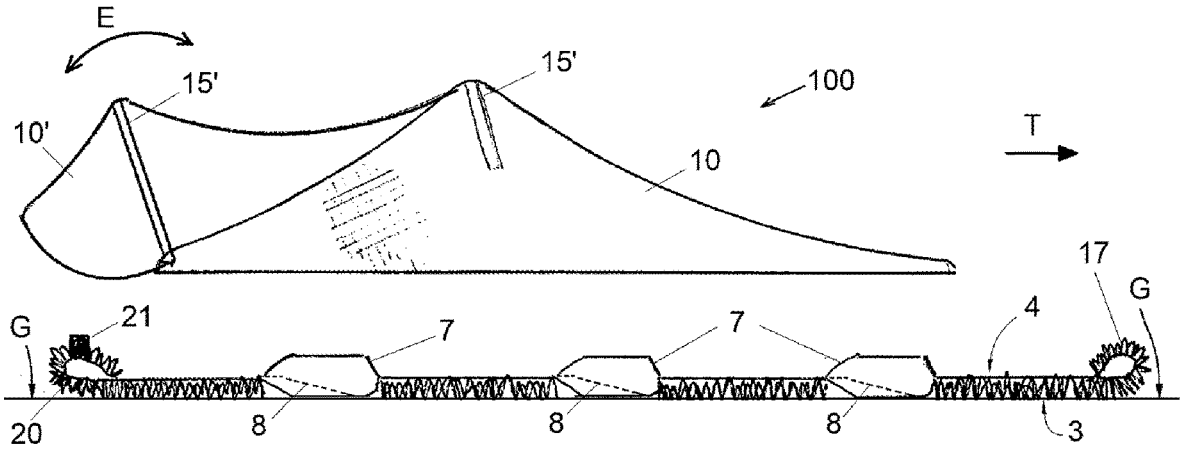
FIG. 9 is a side view of a sweeper apparatus according to a further embodiment of the disclosure, with debris retaining assembly of FIG. 8 shown separate.
Figure 10:
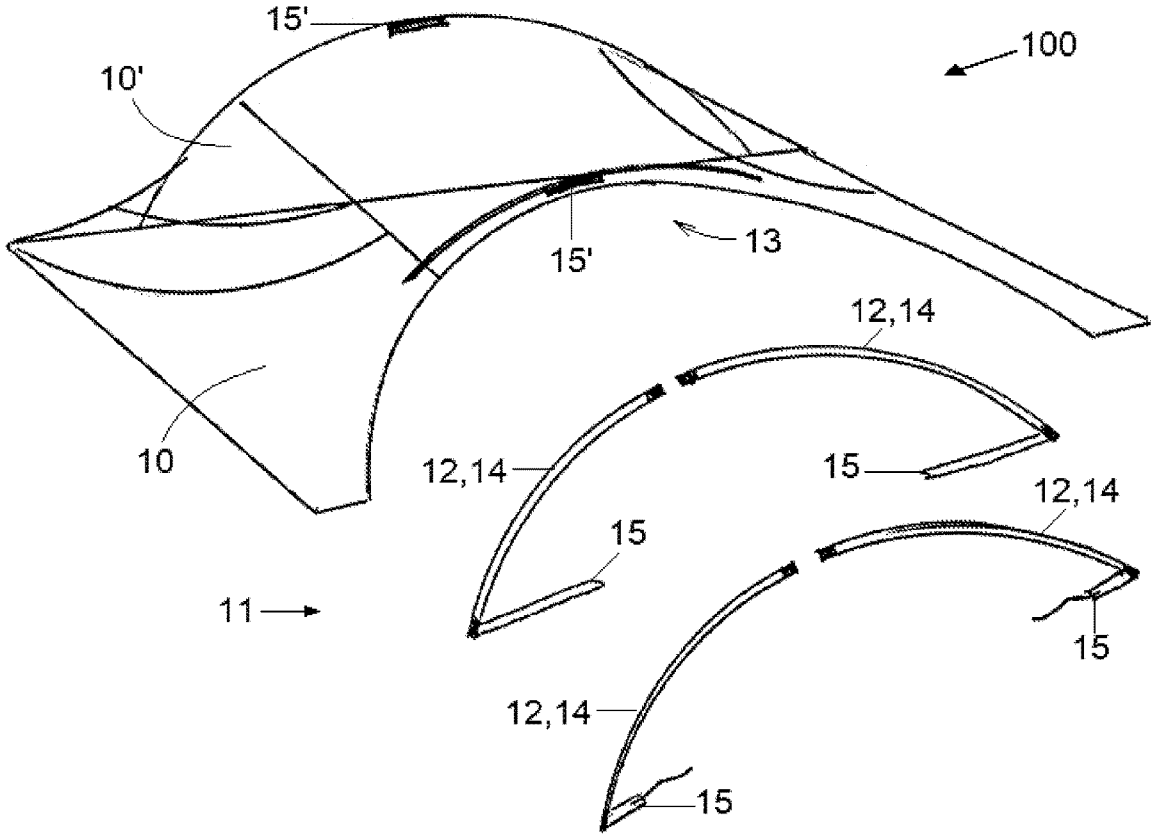
FIG. 10 is a perspective view of the debris retaining assembly of FIG. 8 and FIG. 9.

With reference to drawing FIGS. 8 to 10, a sweeper apparatus 1 and associated assembly 100 according to a further embodiment of the disclosure is shown in a range of views. In this embodiment, the cover 10 of the debris retaining assembly 100 includes a rearward extension 10' that is movable in the direction of arrows E. Considering FIG. 8, the assembly 100 is shown in plan view separated into component parts, including three fabric panels 24, 25, 26 and two pairs of curved ribs or battens 14 forming frame members 12 of the frame 11. Each pair of curved ribs or battens 14 forms or defines a single transverse or lateral span across a width of panel member 2 generally perpendicular to the direction of travel T. To this end, the two partial sleeves or pockets 15" combine when the two fabric panels 24, 25 are stitched together to form a single sleeve or pocket 15' corresponding to the one shown in FIGS. 5 and 6. Indeed, the portion of cover 10 in FIG. 8 comprising the fabric panels 24, 25 generally corresponds to the cover 10 in FIGS. 5 and 6. By adding the extension 10' formed of the fabric panel 26 with a further pair of curved ribs or battens 14, the cover 10, 10' in this embodiment then assumes the form illustrated in FIGS. 9 and 10. As will be appreciated, this assembly 100 affords a substantially larger collection space 13 for holding or retaining debris on the upper side 4 of the mat or panel member 2 in use. The fact that each transverse or lateral span of the frame 11 across the panel member 2 comprises a pair of frame members (i.e., ribs or battens 14) in end-to-end relationship to form the single span provides for enhanced collapsibility of the assembly in storage.

Figure 11:
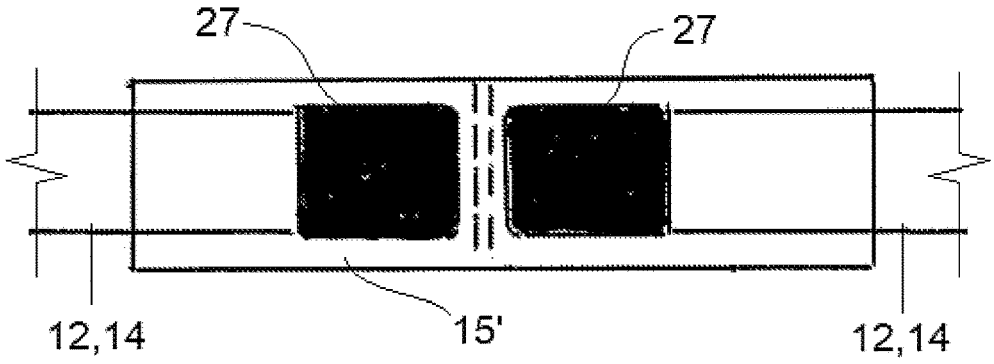
FIG. 11 is a top view of adjacent ends of the frame members of the debris retaining assembly shown in FIG. 10.
Figure 12A:
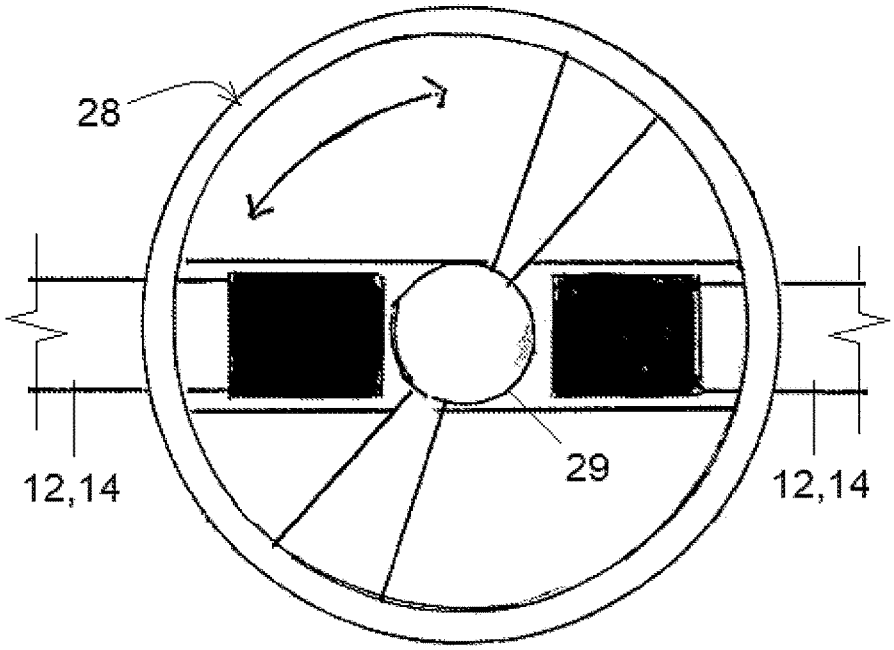
FIG. 12*a* is a top view of the ends of the frame members of a debris retaining assembly according to an alternative embodiment of the disclosure.
Figure 12B:
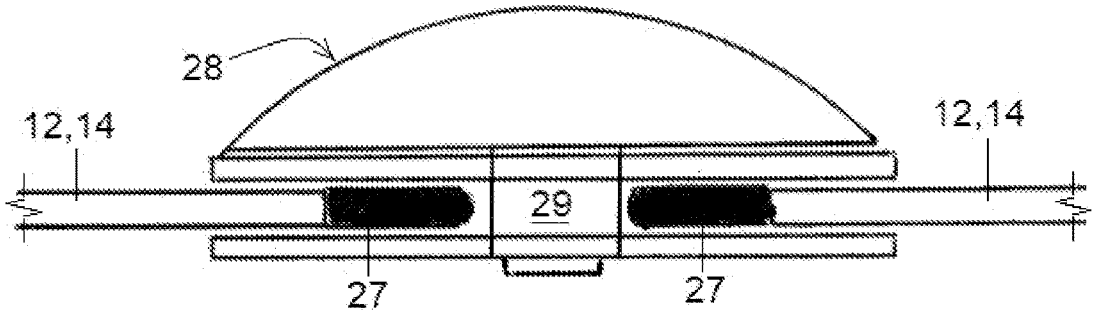
FIG. 12*b* is a front view of the ends of the frame members in FIG. 12*a*.

With reference to FIG. 11, the adjacent ends 27 of the frame members 12 (i.e., of the ribs or battens 14) may be simply received in respective sleeves or pockets 15' in the cover 10' and separated by one or more lines of stitching. Alternatively, however, with reference in FIGS. 12*a* and 12*b*, the frame 11 may include a pivot joint 28 provided in this example in the form of a disc joint, that receives and accommodates the ends 27 of the respective frame members 12 (i.e., of the ribs or battens 14) and provides for relative rotation about a central axis or pivot pin 29 of the joint 28. The pivot joint 28 may also be lockable with the frame members 12 (i.e., ribs or battens 14) may in a particular orientation or position—e.g., an extended position or a collapsed position.

Although specific embodiments of the disclosure are illustrated and described herein, it will be appreciated by persons of ordinary skill in the art that a variety of alternative and/or equivalent implementations exist. It should be appreciated that each exemplary embodiment is an example only and is not intended to limit the scope, applicability, or configuration in any way. Rather, the foregoing summary and detailed description will provide those persons skilled in the art with a convenient road map for implementing at least one exemplary embodiment, it being understood that various changes may be made in the function and arrangement of elements described in an exemplary embodiment without departing from the scope as set forth in the present disclosure. Generally, this application is intended to cover any adaptations or variations of the specific embodiments discussed herein. As an example, a skilled person will readily appreciate that the sweeper apparatus of the disclosure is not limited to being made from any specific material described in the embodiments. Rather, the skilled person will appreciate that a range of suitable materials exist and that the skilled person can select a material based upon the known mechanical properties of that material which make it suitable for use in the apparatus.

It will also be appreciated that the terms "comprise", "comprising", "include", "including", "contain", "containing", "have", "having", and any variations thereof, as used in this document are intended to be understood in an inclusive (i.e., non-exclusive) sense, such that the process, method, device, apparatus, or system described herein is not limited to the features, integers, parts, elements, or steps recited but may include other features, integers, parts, elements, or steps not expressly listed and/or inherent to such process, method, device, apparatus, or system. Furthermore, the terms "a" and "an" used herein are intended to be understood as meaning one or more unless explicitly stated otherwise. In addition, reference to positional terms, such as "lower" and "upper", used in the above description are to be taken in context of the embodiments depicted in the figures, and are not to be taken as limiting the disclosure to the literal interpretation of the term but rather as would be understood by a skilled addressee in the appropriate context.

DRAWING REFERENCE SIGNS

1 apparatus
2 panel member
3 underside
4 upper side
5 collection surface
6 opening
7 guide structure
8 inclined surface
9 rear edge
10 cover
11 frame
12 frame member
13 collection space
14 rib or strut or batten
15 strap
15' sleeve, pocket, channel, or cuff
15" partial sleeve, pocket, channel, or cuff
16 opening
17 leading edge
18 row of openings
19 ground-engaging pad or strip
20 trailing edge
21 handle
22 towing member
23 closure or flap
24 fabric panel
25 fabric panel
26 fabric panel
27 end of frame member, batten or rib
28 pivot joint
29 pivot pin
100 assembly
G ground surface

The invention claimed is:

1. An apparatus for sweeping a ground surface, comprising:

a panel member configured to be moved across the ground surface to sweep the ground surface, the panel member having an underside that, in use, faces the ground surface to be swept, an upper side that provides a collection surface for collecting debris swept from the ground surface, and one or more openings that extend between the underside and the upper side for conveying debris from the ground surface to the collection surface; and a debris retaining assembly that is provided or mounted on the panel member for trapping debris conveyed to the collection surface on the upper side of the panel member, the debris retaining assembly comprising a frame and a flexible cover supported on the frame spaced above the collection surface, wherein the frame comprises at least one frame member that is elongate and resiliently flexible and that, in use, spans or extends across a substantial width of the panel member to tension and shape the flexible cover spaced above the collection surface, and wherein the at least one frame member is configured to be secured at opposite end regions thereof in a releasable manner to the panel member and extends between said opposite end regions to shape the flexible cover and to define a collection space between the flexible cover and the collection surface on the upper side of the panel member.

2. The apparatus according to claim 1, wherein the at least one frame member comprises a rib or a strut or a batten for supporting the flexible cover spaced above the collection surface, wherein the panel member is generally rectangular and the at least one frame member extends substantially parallel to a leading edge of the panel member and extends substantially perpendicular to a direction of travel.

3. The apparatus according to claim 2, wherein the at least one frame member comprises a single frame member, or wherein the at least one frame member defines a single span across the panel member and comprises a plurality of frame members in end-to-end relationship.

4. The apparatus according to claim 2, wherein the flexible cover comprises a flexible sheet of material and wherein the at least one frame member shapes the flexible cover over the collection surface, wherein the flexible cover is configured to receive the at least one frame member.

5. The apparatus according to claim 1, wherein the flexible cover comprises a textile material or a mesh material which is air-permeable, and/or wherein the flexible cover incorporates an elastic material to facilitate tensioning and shaping of the flexible cover over the frame of the debris retaining assembly.

6. The apparatus according to claim 1, wherein the debris retaining assembly is configured to be releasably mounted on or fixed to the panel member via one or more straps or releasable fasteners provided on the flexible cover and/or on the frame.

7. The apparatus according to claim 1, wherein the flexible cover, when mounted on the panel member, defines an opening into a collection space between the flexible cover and the collection surface on the upper side of the panel member, wherein the opening faces a forward direction or a direction of travel in which the apparatus is configured to be moved across the ground surface.

8. The apparatus according to claim 7, wherein the opening extends across a substantial width of the panel member, and/or wherein the flexible cover includes a closure for covering or obscuring the opening into the collection space.

9. The apparatus according to claim 1, wherein each of the one or more openings in the panel member comprises, or is formed within, a guide structure for guiding transfer or conveyance of debris from the ground surface to the collection surface of the apparatus, and wherein the guide structure includes an inclined surface which extends upwards and rearwards, in use, from a position close to the ground surface to a rear edge of a respective opening adjacent the collection surface.

10. An apparatus for sweeping a ground surface, comprising:

a panel member configured to be moved across the ground surface to sweep the ground surface, the panel member having an underside that, in use, faces the ground surface to be swept, and an upper side that provides a collection surface for collecting debris swept from the ground surface; and a cover to be mounted on the panel member for trapping the debris conveyed to the collection surface on the upper side of the panel member, wherein the cover, when mounted on the panel member, forms a canopy that is supported spaced above the panel member to define a collection space between the cover and the upper side of the panel member, wherein the cover is tensioned and shaped by at least one elongate and resiliently flexible frame member that, in use, spans or extends across a substantial width of the panel member to support the cover above the collection surface, wherein the at least one elongate and resiliently flexible frame member is configured to be secured at opposite end regions thereof in a releasable manner to the panel member and extends between said opposite end regions to shape the cover and to define a collection space between the cover and the collection surface on the upper side of the panel member.

11. The apparatus according to claim 10, wherein the cover, when mounted on the panel member, presents an opening into the collection space between the cover and the upper side of the panel member, the opening facing a direction in which the apparatus is configured to be moved across the ground surface to sweep the ground surface.

12. The apparatus according to claim 11, wherein the opening extends across a substantial width of the panel member.

13. A sweeper for a ground surface, comprising:

a mat-like panel configured to be moved across the ground surface to sweep the ground surface, the panel having an underside that, in use, faces the ground surface to be swept, an upper side that provides a collection surface for collecting debris swept from the ground surface, and one or more openings that extend between the underside and the upper side for conveying debris from the ground surface to the collection surface on the upper side of the panel; and a flexible cover configured to be mounted on the upper side of the panel for trapping the debris conveyed to the collection surface, the flexible cover being supported spaced above the collection surface when mounted on the panel by at least one frame member that is elongate and resiliently flexible and that tensions and shapes the flexible cover, the at least one frame member spanning or extending across a substantial width of the panel in use, and the flexible cover being stretched or tensioned by the at least one frame member to form an opening in a forward-facing direction to a collection space between the cover and the collection surface on the upper side of the mat-like panel.

14. The sweeper according to claim 13, wherein the mat-like panel is rectangular and the at least one frame member extends substantially parallel to a leading edge of the mat-like panel and substantially perpendicular to a direction of travel, and wherein the flexible cover is stretched or tensioned by the at least one frame member above the collection surface to form the opening in the forward-facing direction across a substantial width of the mat-like panel.

15. A debris retaining assembly for an apparatus for sweeping a ground surface with a panel member, an underside of the panel member in use facing the ground surface to be swept, and an upper side of the panel member providing a collection surface for collecting debris swept from the ground surface, wherein the debris retaining assembly is configured to be mounted on the panel member for trapping the debris conveyed to the collection surface on the upper side of the panel member, wherein the debris retaining assembly comprises a frame having at least one frame member and a flexible cover supported on the frame so as to be spaced above the collection surface when the debris retaining assembly is mounted on the panel member, and wherein the at least one frame member is elongate and flexible and spans or extends across a substantial width of the panel member in use to tension and shape the flexible cover spaced above the collection surface, wherein the at least one frame member is configured to stretch the flexible cover above the panel member and extends in a releasable manner between opposite end regions thereof to shape the flexible cover and to define a collection space between the flexible cover and the collection surface on the upper side of the panel member.

16. The debris retaining assembly according to claim 15, wherein the at least one frame member comprises a rib or a strut or a batten for supporting the flexible cover spaced above the collection surface; wherein the flexible cover is a flexible textile material or mesh material.

17. A cover for an apparatus for sweeping a ground surface with a panel member, an underside of the panel member in use facing the ground surface to be swept, and an upper side of the panel member providing a collection surface for collecting debris swept from the ground surface, wherein the cover is configured to be mounted on the panel member for trapping the debris conveyed to the collection surface on the upper side of the panel member, wherein the cover, when mounted on the panel member, forms a canopy that is spaced above the panel member to define a collection space between the cover and the upper side of the panel member, and wherein the cover includes at least one elongate flexible frame member that, in use, spans or extends across a substantial width of the panel member for tensioning and shaping the cover spaced above the collection surface.

18. The cover according to claim 17, wherein, when mounted on the panel member, the cover defines an opening into the collection space between the cover and collection surface on the upper side of the panel member, wherein the opening faces a forward direction or direction of travel in which the apparatus is configured to be moved across the ground surface.

19. The cover according to claim 17, wherein, when mounted on the panel member, the at least one frame member of the cover extends substantially parallel to a leading edge of the panel member and/or substantially perpendicular to a direction of travel in which the apparatus is configured to be moved across the ground surface.

* * * * *